US012590729B2

(12) United States Patent
Sakarwala

(10) Patent No.: US 12,590,729 B2
(45) Date of Patent: Mar. 31, 2026

(54) DRAIN ASSEMBLY FOR HEAT EXCHANGER SYSTEM

(71) Applicant: Rheem Manufacturing Company, Atlanta, GA (US)

(72) Inventor: Ammar K. Sakarwala, Lewisville, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 246 days.

(21) Appl. No.: 18/323,537

(22) Filed: May 25, 2023

(65) Prior Publication Data

US 2023/0383991 A1 Nov. 30, 2023

Related U.S. Application Data

(60) Provisional application No. 63/365,335, filed on May 26, 2022.

(51) Int. Cl.
*F24F 13/22* (2006.01)
*F28F 17/00* (2006.01)

(52) U.S. Cl.
CPC ..... *F24F 13/222* (2013.01); *F28F 17/005* (2013.01); *F28F 2270/00* (2013.01)

(58) Field of Classification Search
CPC .. F24F 13/222; F24F 2013/227; F28F 17/005; F28F 2270/00; F28F 2265/10; F28B 9/08
See application file for complete search history.

(56) References Cited

U.S. PATENT DOCUMENTS 2,210,725 A * 8/1940 Macmaster ..... A47F 3/0417 62/286
4,907,420 A * 3/1990 Mahanay ..... F25D 21/14 62/291
5,071,027 A * 12/1991 Sullivan ..... F24F 13/22 220/571
5,195,332 A * 3/1993 Sullivan ..... F24F 1/0033 62/291
5,481,886 A * 1/1996 Hasegawa ..... F28D 1/0341 62/285

(Continued)

FOREIGN PATENT DOCUMENTS

CN 105465890 A 4/2016
EP 1004831 A2 5/2000
WO 2017022131 A1 2/2017

OTHER PUBLICATIONS

International Search Report and Written Opinion of PCT Application No. PCT/US2023/023527 mailed Sep. 21, 2023 (14 pages).

*Primary Examiner* — Travis Ruby
(74) *Attorney, Agent, or Firm* — Eversheds Sutherland (US) LLP

(57) ABSTRACT

The present disclosure provides a drain assembly for an AC furnace coil unit. The drain assembly includes a drain pan defining one or more drain channels extending longitudinally therealong, and an arcuate heat shield detachably coupled to the drain pan. The arcuate heat shield extends along a length of the drain pan. The arcuate heat shield is configured to define a cavity between an inner surface thereof and the drain pan, and distribute airflow, incident on an outer surface thereof, along longitudinal sides of the drain pan.

20 Claims, 9 Drawing Sheets

(56) References Cited

U.S. PATENT DOCUMENTS

| | | | | |
|---|---|---|---|---|
| 6,729,152 | B2 * | 5/2004 | Gully | B60H 1/00514 62/276 |
| 7,430,877 | B2 * | 10/2008 | Davenport | F24F 13/224 62/272 |
| 7,669,641 | B2 * | 3/2010 | Rembold | F24F 13/222 165/53 |
| 8,869,548 | B2 * | 10/2014 | Piccione | F24F 13/222 62/291 |
| 9,759,446 | B2 * | 9/2017 | Stewart | F24F 13/30 |
| 10,077,917 | B2 * | 9/2018 | Amick | F24F 1/0071 |
| 2003/0213265 | A1 * | 11/2003 | Gully | B60H 1/00514 62/515 |
| 2007/0169498 | A1 | 7/2007 | Rios | |
| 2013/0068421 | A1 * | 3/2013 | Army | F28F 11/00 165/70 |
| 2018/0031335 | A1 * | 2/2018 | Graham | F28F 3/044 |
| 2020/0208872 | A1 | 7/2020 | Lanning | |
| 2022/0186977 | A1 * | 6/2022 | Phillips | F28F 9/001 |
| 2022/0235980 | A1 * | 7/2022 | Mercer | F28D 1/0426 |
| 2023/0358419 | A1 * | 11/2023 | Mercer | F24F 13/20 |
| 2023/0392821 | A1 * | 12/2023 | Sakarwala | F28D 1/0477 |

* cited by examiner

DRAIN ASSEMBLY FOR HEAT EXCHANGER SYSTEM

CROSS-REFERENCE TO RELATED APPLICATION(S)

This application claims priority to and the benefit of U.S. Provisional Application No. 63/365,335, filed on May 26, 2022, the disclosure of which is hereby incorporated herein by reference in its entirety.

TECHNICAL FIELD

The present disclosure relates, in general, to a heat exchanger system and, more specifically relates, to a drain pan assembly for an AC furnace coil unit of the heat exchanger system.

BACKGROUND

Indoor heat exchanger coils in residential split air-conditioning ("AC") systems are typically configured as an N-coil, an A-coil, or a V-coil. Present day indoor heat exchanger coils include a drain pan at a base thereof to collect condensate formed on the coil. Typically, the center of the base of the coil and hence the drain pan is disposed proximal to a heat exchanger. Because AC coils are installed in conjunction with a gas furnace, during operation, a forced heated stream of air from the furnace flowing across the heat exchanger contacts an outer surface of the drain pan. The drain pan is required to split the forced heated stream of air and direct the split streams of air across the slabs of the coil. Due to the proximity to the gas furnace heat exchanger (above which the AC coil is installed), the drain pan should be configured to withstand heat radiation from the heat exchanger. In order to address such need, conventional plastic molded drain pans include expensive heat resistant plastic material and/or a thick base to withstand the heat radiation or include a metal plate attached to a base thereof to reflect the heat radiation. However, achieving such thick base of the drain pan demands use of more plastic material, thereby increasing the cost of the drain pan and associated manufacturing costs. The metal plate attached to the base of the drain pan may also fail to prevent transmission of heat to the drain pan during prolonged use of the split air-conditioning systems.

SUMMARY

According to one aspect of the present disclosure, a drain assembly for an AC furnace coil unit is disclosed. The drain assembly includes a drain pan defining one or more drain channels extending longitudinally therealong, and an arcuate heat shield detachably coupled to the drain pan. The arcuate heat shield extends along a length of the drain pan. The arcuate heat shield is configured to define a cavity between an inner surface thereof and the drain pan, and distribute airflow, incident on an outer surface thereof, along longitudinal sides of the drain pan.

In an embodiment, the drain pan defines two or more receiving portions, and the arcuate heat shield includes two or more attachment portions configured to engage with the two or more receiving portions.

In an embodiment, the longitudinal sides of the drain pan are arcuate. In an embodiment, the longitudinal sides of the drain pan, and the arcuate heat shield together defines a continuous arcuate surface.

In an embodiment, the drain pan is made of plastic and the arcuate heat shield is made from sheet metal.

According to another aspect of the present disclosure, a heat exchanger system is disclosed. The heat exchanger system includes a gas furnace unit and an AC furnace coil unit. The gas furnace unit includes a blower and a furnace heat exchanger disposed downstream of the blower with respect to an airflow from by the blower. The AC furnace coil unit includes an AC evaporator heat exchanger disposed downstream of the furnace heat exchanger with respect to the airflow from the blower. The AC furnace coil unit also includes a drain assembly coupled to the AC evaporator heat exchanger and configured to collect condensate from the AC evaporator heat exchanger. The drain assembly includes a drain pan defining one or more drain channels extending longitudinally therealong and an arcuate heat shield detachably coupled to the drain pan. The arcuate heat shield extends along a length of the drain pan. The arcuate heat shield is configured to define a cavity between an inner surface thereof and the drain pan, and distribute airflow, incident on an outer surface thereof, along longitudinal sides of the drain pan.

In an embodiment, the drain pan defines two or more receiving portions, and the arcuate heat shield includes two or more attachment portions configured to engage with the two or more receiving portions.

In an embodiment, the arcuate heat shield is made from sheet metal. In an embodiment, the cavity is configured to prevent heat transfer from the arcuate heat shield to the drain pan.

In an embodiment, the longitudinal sides of the drain pan are arcuate. In an embodiment, the longitudinal sides of the drain pan and the arcuate heat shield together defines a continuous arcuate surface.

In an embodiment, the arcuate heat shield is configured to minimize a pressure drop in the airflow downstream of the AC evaporator heat exchanger. In an embodiment, a magnitude of pressure drop is in a range of about 15 Pascals (Pa) to about 20 Pa.

In an embodiment, the AC evaporator heat exchanger is a V-shaped evaporator coil.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Figure 1:
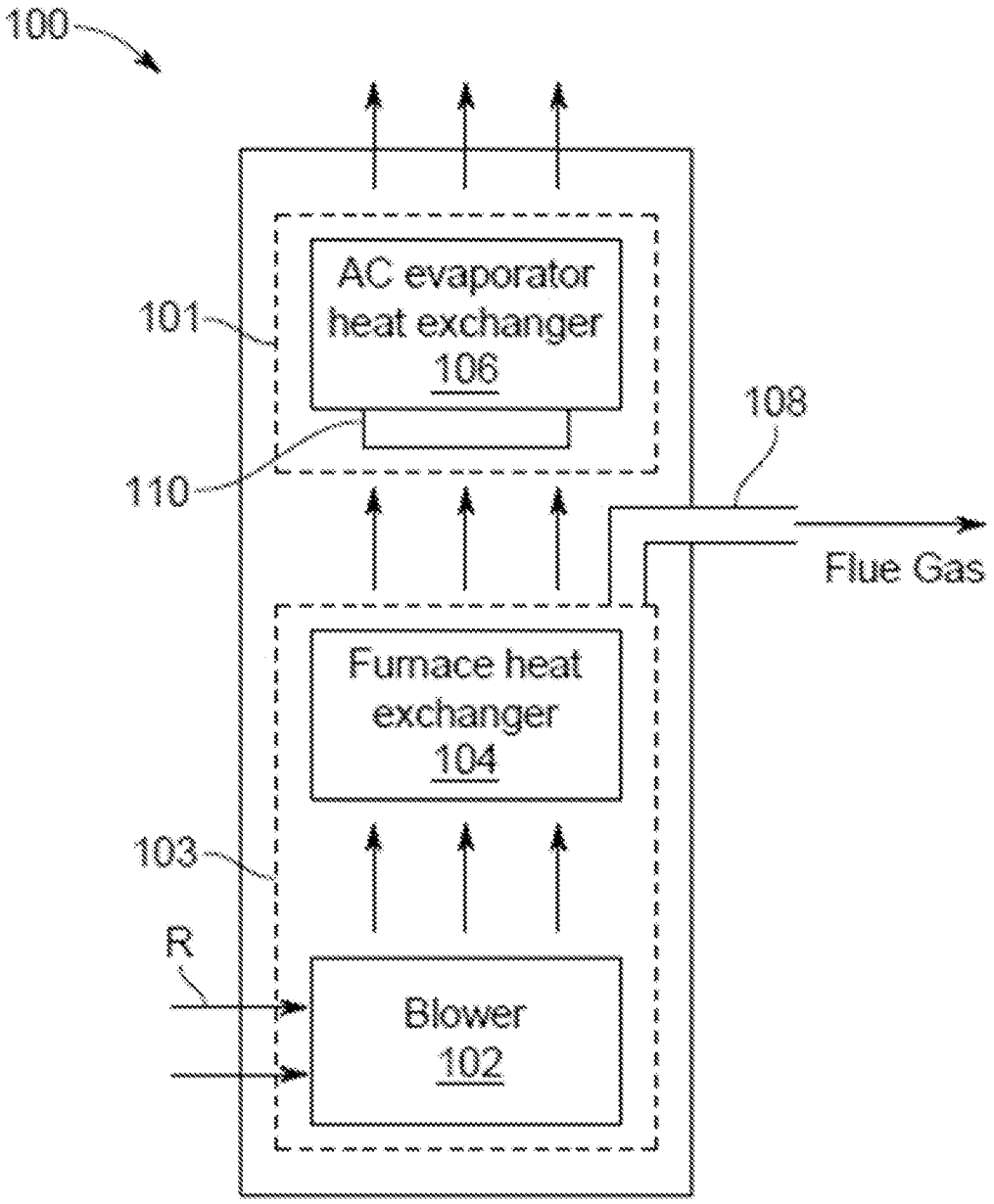
FIG. 1 is a schematic block diagram of a heat exchanger system, according to an embodiment of the present disclosure.

Reference will now be made in detail to specific embodiments or features, examples of which are illustrated in the accompanying drawings. Wherever possible, corresponding, or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Although various aspects of the disclosed technology are explained in detail herein, it is to be understood that other aspects of the disclosed technology are contemplated. Accordingly, it is not intended that the disclosed technology is limited in its scope to the details of construction and arrangement of components expressly set forth in the following description or illustrated in the drawings. The disclosed technology can be implemented and practiced or carried out in various ways. Accordingly, when the present disclosure is described as a particular example or in a particular context, it will be understood that other implementations can take the place of those referred to.

It should also be noted that, as used in the specification and the appended claims, the singular forms "a," "an," and "the" include plural references unless the context clearly dictates otherwise. References to a composition containing "a" constituent is intended to include other constituents in addition to the one named.

Also, in describing the disclosed technology, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, the disclosed technology can include from the one particular value and/or to the other particular value. Further, ranges described as being between a first value and a second value are inclusive of the first and second values. Likewise, ranges described as being from a first value and to a second value are inclusive of the first and second values.

It is also to be understood that the mention of one or more method steps does not preclude the presence of additional method steps or intervening method steps between those steps expressly identified. Moreover, although the term "step" can be used herein to connote different aspects of methods employed, the term should not be interpreted as implying any particular order among or between various steps herein disclosed unless and except when the order of individual steps is explicitly required. Further, the disclosed technology does not necessarily require all steps included in the methods and processes described herein. That is, the disclosed technology includes methods that omit one or more steps expressly discussed with respect to the methods described herein.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

The components described hereinafter as making up various elements of the disclosed technology are intended to be illustrative and not restrictive. Many suitable components that would perform the same or similar functions as the components described herein are intended to be embraced within the scope of the disclosed technology. Such other components not described herein can include, but are not limited to, similar components that are developed after development of the presently disclosed subject matter.

Referring to FIG. 1, a schematic block diagram of a heat exchanger system 100 (hereinafter referred to as "the system 100") is illustrated. The system 100 includes an AC furnace coil unit 101 and a gas furnace unit 103 disposed upstream with respect to the AC furnace coil unit 101. The gas furnace unit 103 includes a blower 102 configured to direct return air "R" from a space to be heated (such as a living room) across a furnace heat exchanger 104. The furnace heat exchanger 104 is disposed downstream of the blower 102 with respect to an airflow from the blower 102. Although not illustrated in FIG. 1, it will be understood that the gas furnace unit 103 also includes a burner charged by fuel, such as natural gas, where products of combustion from the burner is directed through the furnace heat exchanger 104 and subsequently exhausted from the furnace heat exchanger 104 through a flue gas pipe 108 by a draft inducer (not shown). The AC furnace coil unit 101, among other components, includes an AC evaporator heat exchanger 106 disposed downstream of the furnace heat exchanger 104 with respect to the airflow from the blower 102, and a drain assembly 110 coupled to or otherwise associated with the AC evaporator heat exchanger 106. The drain assembly 110 is configured to collect condensate from the AC evaporator heat exchanger 106. In heating operations, the return air "R" directed across the furnace heat exchanger 104 is heated by the products of combustion flowing through the furnace heat exchanger 104. Further, the heated air flows across the AC evaporator heat exchanger 106 before being supplied to the space to be heated. In cooling operations, the air flows across the furnace heat exchanger with no change in temperature before arriving at the evaporator coil which cools the air down while also removing humidity.

Figure 2:
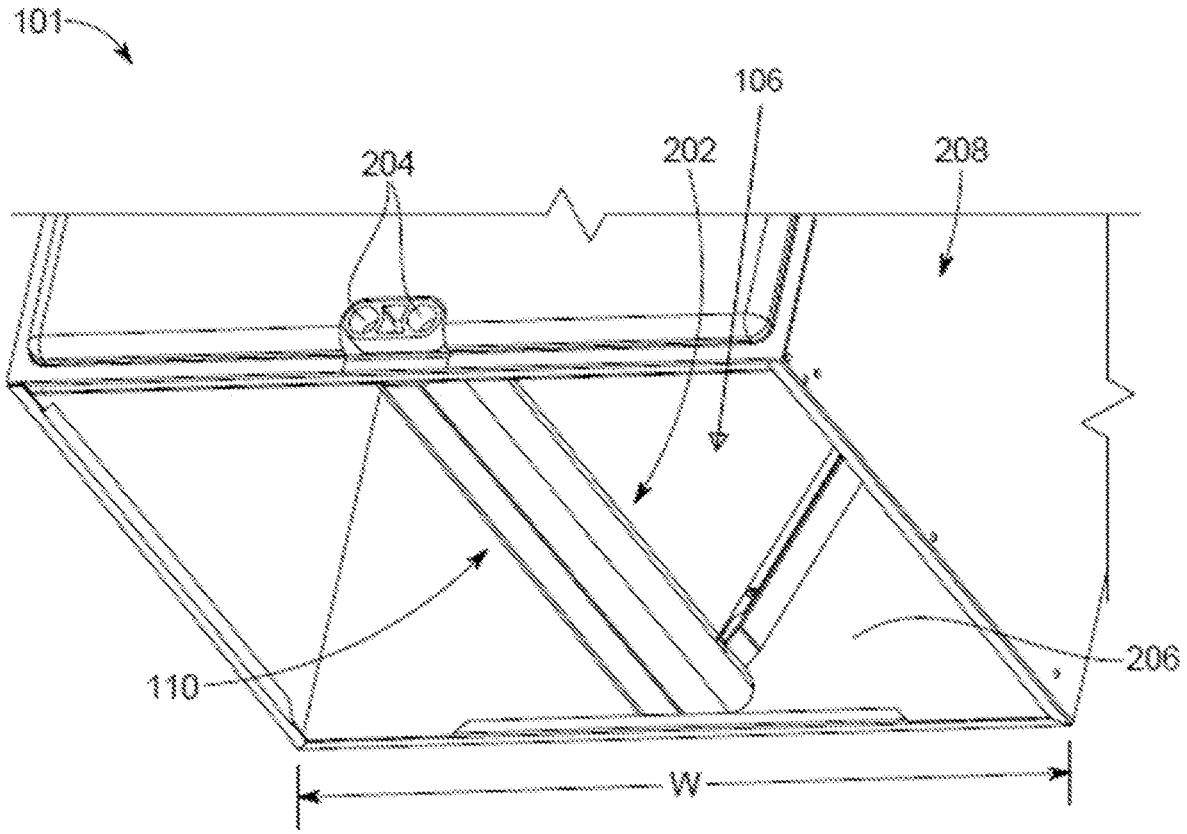
FIG. 2 is a bottom perspective view of a portion of an AC furnace coil unit of the heat exchanger system of FIG. 1 showing a drain assembly, according to an embodiment of the present disclosure.

FIG. 2 illustrates a bottom perspective view of a portion of the AC furnace coil unit 101. Particularly, FIG. 2 illustrates the drain assembly 110 coupled to a base of the AC evaporator heat exchanger 106. According to an aspect, the AC evaporator heat exchanger 106 is embodied as a V-coil heat exchanger and the drain assembly 110 is coupled to a converging end 202 of the V-coil heat exchanger. As shown in the FIG. 2, in one arrangement, the converging end of the V-coil heat exchanger is located proximal to furnace heat exchanger 104. In some aspects, the AC evaporator heat exchanger 106 may be implemented as V-shaped evaporator coil.

Figure 3:
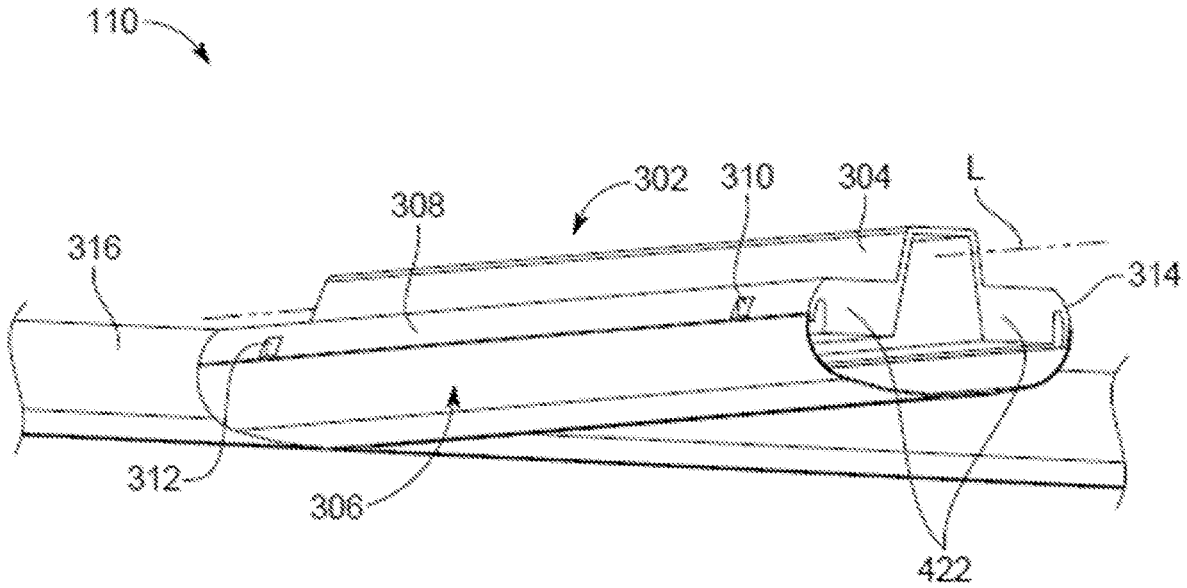
FIG. 3 is a perspective view of the drain assembly of FIG. 2, according to an embodiment of the present disclosure.

FIG. 3 illustrates a perspective view of the drain assembly 110. According to an aspect, the drain assembly 110 includes a drain pan 302 configured to receive converging end 202 of the V-coil heat exchanger. The drain pan 302 includes a raised portion 304 extending along a longitudinal axis "L" thereof. The drain assembly 110 also includes an arcuate heat shield 306 detachably coupled to the drain pan 302 and extending along a length of the drain pan 302. The drain pan 302 defines two or more receiving portions on each of the sides thereof. A first longitudinal side 308 of the drain pan 302 defines a first receiving portion 310 and a second receiving portion 312. Similarly, a second longitudinal side 314 of the drain pan 302 defines receiving portions, such as a first attachment portion 410 (see FIG. 4) corresponding to the receiving portion 310. A fourth receiving portion (not shown in FIG. 3 or FIG. 4) may be defined on the second longitudinal side 314 corresponding to the second receiving portion 312. In some embodiments, each of the first longitudinal side 308 and the second longitudinal side 314 may define multiple receiving portions. In an embodiment, the drain pan 302 may be made of plastic. For example, the drain pan 302 may be molded using plastic. The drain pan 302 also includes a support member 316 extending perpendicular with respect to the raised portion 304. A length of the support member 316 may be less than a width "W" of the cabinet 208 to allow positioning of the drain assembly 110 and the V-coil heat exchanger within the cabinet 208. Ends of the support member 316 may be fixed to the cabinet 208 via suitable fasteners.

Figure 4:
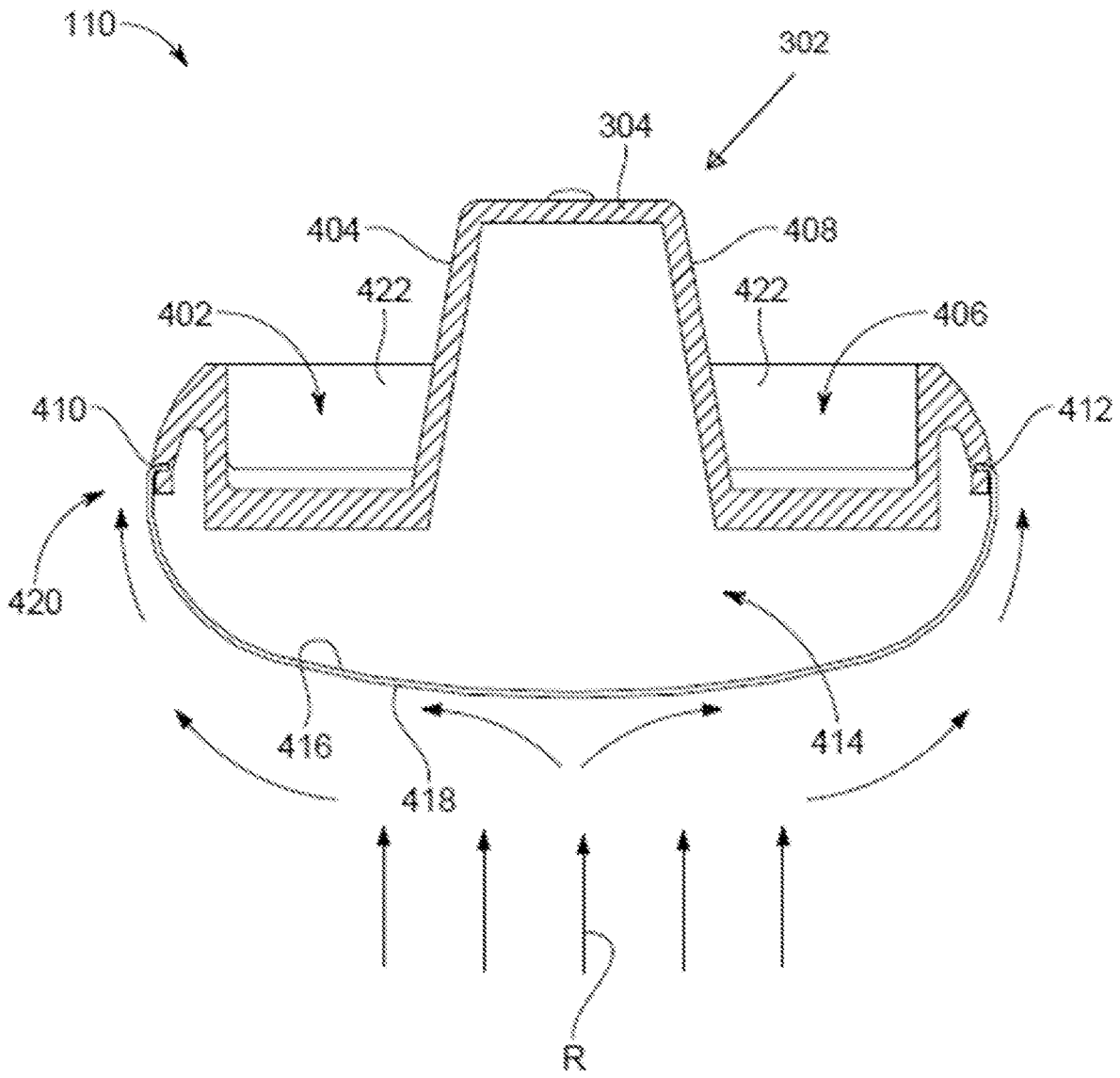
FIG. 4 is a cross-sectional view of the drain assembly of FIG. 2, according to an embodiment of the present disclosure.

FIG. 4 illustrates a cross-sectional view of the drain assembly 110. The drain pan 302 defines one or more drain channels extending longitudinally therealong (i.e., extending parallel to the longitudinal axis "L"). Specifically, the drain pan 302 defines a first drain channel 402 on a first side 404 of the raised portion 304 and a second drain channel 406 on a second side 408 of the raised portion 304. Condensate from each slab of the V-coil heat exchanger is collected in the corresponding drain channel and directed out of the AC furnace coil unit 101 via drain openings 204 (see FIG. 2). One end of each of the first drain channel 402 and the second drain channel 406 includes a wall 422 (also shown in FIG. 3) to retain condensate with the drain channels 402, 406 and prevent leakage of the condensate from rear end 206 (see FIG. 2) of a cabinet 208. Further, the arcuate heat shield 306 may include two or more attachment portions configured to engage with the two or more receiving portions. For example, a first attachment portion 410 of the arcuate heat shield 306 is configured to engage with the first receiving portion 310 of the drain pan 302 and a second attachment portion 412 of the arcuate heat shield 306 is configured to engage with the first attachment portion 410 of the drain pan 302. As such, the number of receiving portions and the number of attachment portions may be equal.

In an embodiment, the arcuate heat shield 306 is made from sheet metal. Owing to the presence of the receiving portions and the attachment portions, the arcuate heat shield 306 may be detachably coupled to the drain pan 302. In a coupled condition, the arcuate heat shield 306 is configured to: (a) define a cavity 414 between an inner surface 416 thereof and the drain pan 302, and (b) distribute the airflow, incident on an outer surface 418 thereof, along the longitudinal sides of the drain pan 302. In an embodiment, the longitudinal sides of the drain pan 302, such as the first longitudinal side 308 and the second longitudinal side 314, are arcuate. As such, the longitudinal sides of the drain pan 302 and the arcuate heat shield 306 together defines a continuous arcuate surface 420. As a result, the arcuate heat shield 306 may blend into the plastic of the drain pan 302.

As described earlier, the converging end of the V-coil heat exchanger is located proximal to furnace heat exchanger 104. The heated air (alternatively referred to as "the airflow" in the present disclosure and referenced as "R" in FIG. 4) flowing across the furnace heat exchanger 104 contacts the outer surface 418 of the arcuate heat shield 306. By virtue of the arcuate shape of the heat shield 306, the airflow incident on the outer surface 418 of the arcuate heat shield 306 is aerodynamically distributed across the curvature of the arcuate heat shield 306 and along the longitudinal sides 308, 314 of the drain pan 302. Further, owing to the continuous arcuate surface 420 together defined by the longitudinal sides 308, 314 of the drain pan 302 and the arcuate heat shield 306, reduction in pressure associated with the airflow may be minimum. As such, the arcuate heat shield 306 is configured to minimize a pressure drop in the airflow downstream of the AC evaporator heat exchanger 106. In an embodiment, a magnitude of the pressure drop is in a range of about 15 Pa to about 20 Pa. Additionally, the cavity is filled with air and configured to prevent heat transfer from the arcuate heat shield 306 to the drain pan 302. Thus, the drain pan 302 is prevented from being heated by the airflow directed across the AC evaporator heat exchanger 106.

To this end, the drain assembly 110 of the present disclosure may aerodynamically and uniformly distribute the incident airflow along the sides thereof with minimum flow resistance and may prevent separation of the airflow. The sheet metal of the arcuate heat shield 306, by virtue of its property, absorbs the heat from the incident airflow and the air present in the cavity functions as an insulating layer to prevent transmission of heat from the arcuate heat shield 306 to the drain pan 302. The air gap between the plastic drain pan and heat shield prevents any of the return air from coming in contact with the plastic drain pan (which is cold during cooling operation due to the cold condensate flowing through its channels. The heat shield temperature will be closer to the return air temperature and this prevents any condensate forming on the outer surface of the heatshield. As such, instances of condensate dripping on the furnace heat exchanger 104 may be eliminated. Since the drain pan 302 is free from heat radiation by the furnace heat exchanger 104, the drain pan 302 may be molded to have a smaller cross-sectional area compared to conventional drain pans. As such, plastic usage in the AC furnace coil unit 101 may be reduced, thereby reducing overall cost of the drain assembly 110.

Figure 5:
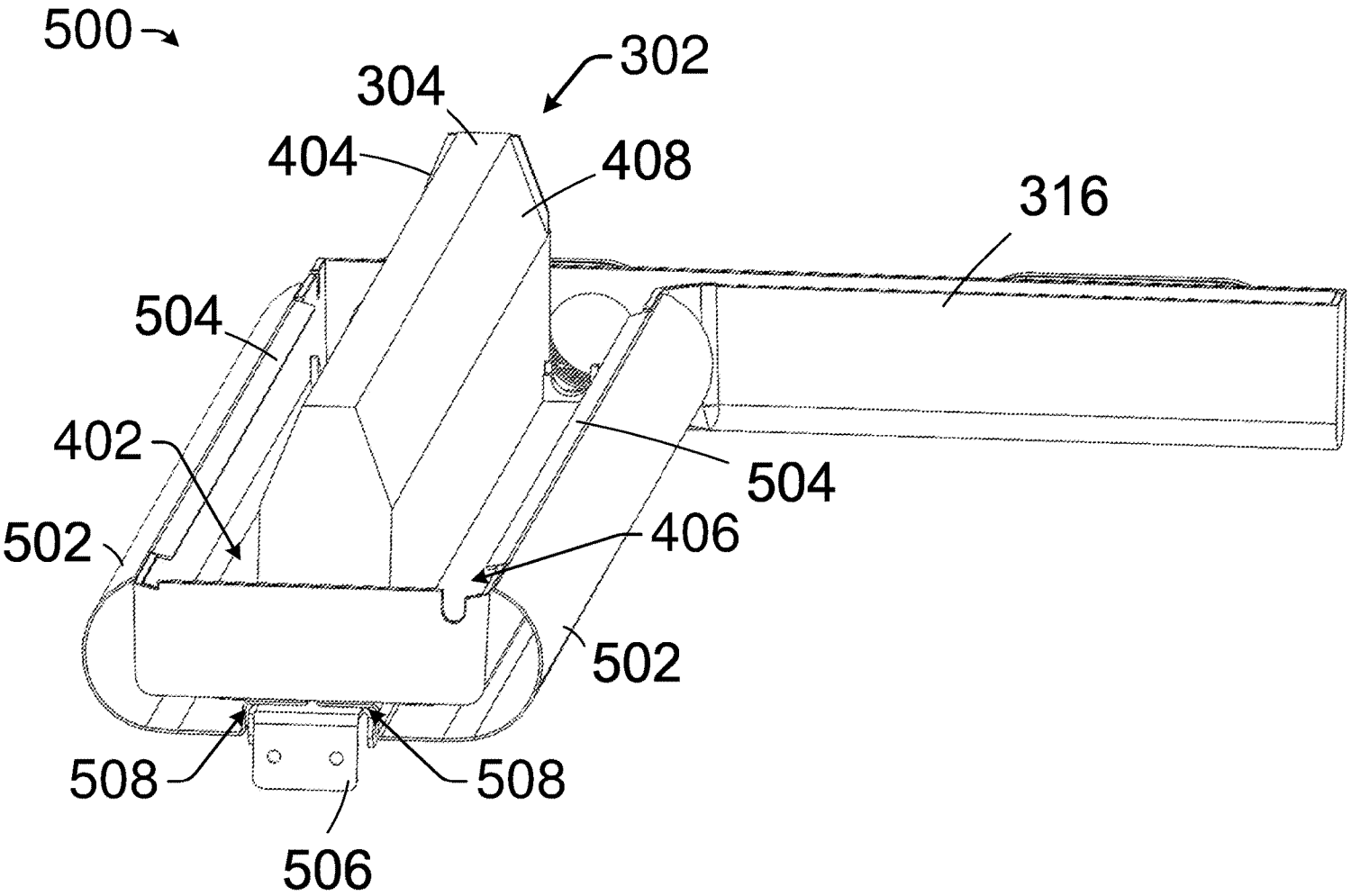
FIG. 5 is a top perspective view of a drain assembly, according to an embodiment of the present disclosure.

FIG. 5 is a top perspective view of a drain assembly 500, according to an embodiment of the present disclosure.

The drain assembly 500 may represent an alternative to the drain assembly 110 of FIG. 2, for example, performing the same functions. Referring to FIG. 5, the drain assembly 500 may include the drain pan 302, the raised portion 304, and the support member 316 of FIG. 3, the first side 404, the second side 408, the first drain channel 402, and the second drain channel 406 of FIG. 4. The drain assembly 110 may include heat shield portions 502 as shown in FIG. 5. In this manner, the two heat shield portions 502 may collectively form a heat shield by being disposed on opposite sides of the drain pan 302. The heat shield portions 502 on both the first side 404 and the second side 408 may include a connecting portion 504, such as a lip (e.g., flange) that extends over a least a portion of the drain pan 302. The heat shield portions 502 may slide into place with the drain pan 302, and may not connect to one another. The bottom of the drain pan 302 may be positioned on or about a bracket 506 such that the drain pan 302 may be elevated with respect to the surface on which the drain pan 302 is positioned (e.g., a floor, the ground, etc.). The heat shield portions 502 on both the first side 404 and the second side 408 may include a connecting portion 508 that may curve (e.g., in an arcuate manner) so as to slide into place between the drain pan 302 and the bracket 506. In some instances, the heat shield portions 502 may be slid into position about the drain pan 302. For example, the connecting portion 508 may be slid in between the bottom surface of the drain pan 302 and the top surface of the bracket 506. That is, the connecting portion 508 may be slid in a direction along the longitudinal axis of the drain pan in between the bottom surface of the drain pan 302 and the top surface of the bracket 506. In this manner, the connecting portion 508 may be sandwiched between the bottom surface of the drain pan 302 and the top surface of the bracket 506 and maintained in place once it is slid therein.

Because of the arcuate profile of the heat shield portions 502, there may be separation between the heat shield portions 502 and the sides of the drain pan 302, as the drain pan 302 may not use the same arcuate profile as the heat shield portions 502 as shown in FIG. 5.

Figure 6:
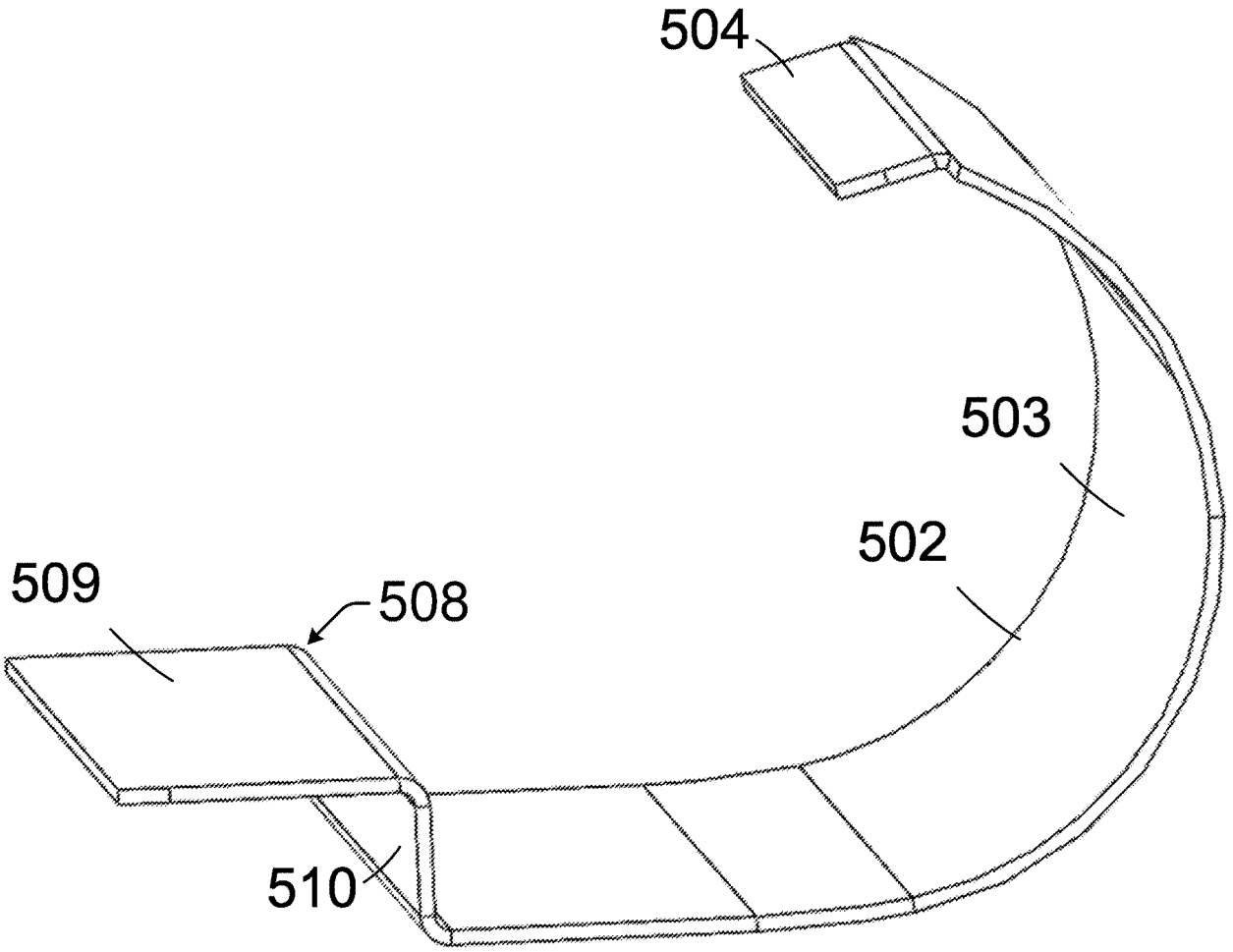
FIG. 6 is a perspective view of the heat shield shown in FIG. 5, according to an embodiment of the present disclosure.

FIG. 6 is a perspective view of the heat shield (e.g., the heat shield portions 502) shown in FIG. 5, according to an embodiment of the present disclosure.

As shown in FIG. 6, the heat shield portions 502 of the heat shield 306 of FIG. 3 may be curved (e.g., in an arcuate manner), and may include the connecting portion 504 and the connecting portion 508. The heat shield portions 502 may be insertable and removable from the drain pan 302 of FIG. 3 using the connecting portion 504 and the connecting portion 508. For example, the heat shield portions 502 may include a curved portion 503 (e.g., arcuate portion) disposed between the connecting portion 504 and the connecting portion 508. In this manner, the connecting portion 504 and the connecting portion 508 may be disposed at opposite ends of the curved portion 503. The connecting portion 508 may include a generally flat first surface 509, which may be configured to be slid between the bottom surface of the drain pan 302 and the top surface of the bracket 506 upon installation. The connecting portion 508 may also include a generally flat second surface 510, which is generally perpendicular to the flat first surface 509. The second surface 510 may be configured to slide along a lateral side of the bracket 506 upon installation. The connecting portion 504 comprises a bent edge configured to mate with the longitudinal sides 308 or 314 of the drain pan 302 as described further with respect to FIG. 7. In this manner, the connecting portion 504 of one of the heat shield portions 502 may mate with the longitudinal side 308, and the connecting portion 504 of one of the heat shield portions 502 may mate with the longitudinal side 314.

Figure 7:
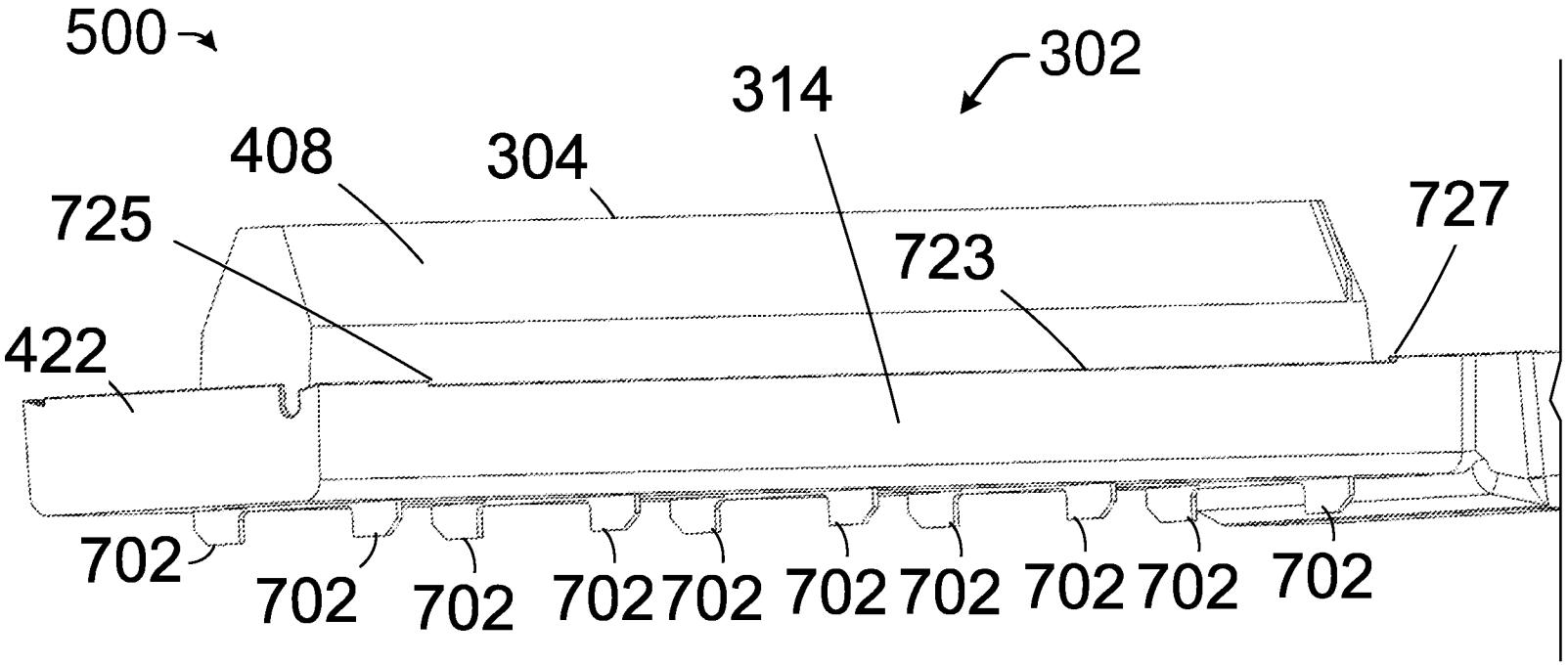
FIG. 7 is a side perspective view of the drain assembly of FIG. 5, according to an embodiment of the present disclosure.

FIG. 7 is a side perspective view of the drain assembly 500 of FIG. 5, according to an embodiment of the present disclosure.

Referring to FIG. 7, the drain pan 302, the raised portion 304, and the second side 408 are shown. The heat shield portions 502 and the bracket 506 of FIG. 5 are not shown so that feet 702 on the bottom of the drain pan 302 are shown. In this manner, the drain pan 302 may be elevated. The longitudinal side 314 (and similarly the longitudinal side 308) of the drain pain 302 may include a slot 723 with which the connecting portion 504 of a respective one of the heat shield portions 502 may mate (e.g., slidably). The slot 723 may represent an indention along a portion of the longitudinal side 314 (and similarly the longitudinal side 308), and the connecting portion 504 may slide along the upper edge of the longitudinal side 314 until the connecting portion 540 drops into the slot 723 between a front lip 725 and a rear lip 727 of the slot 723. In this manner, the length of the connecting portion 504 may correspond to the length of the slot 723.

Figure 8:
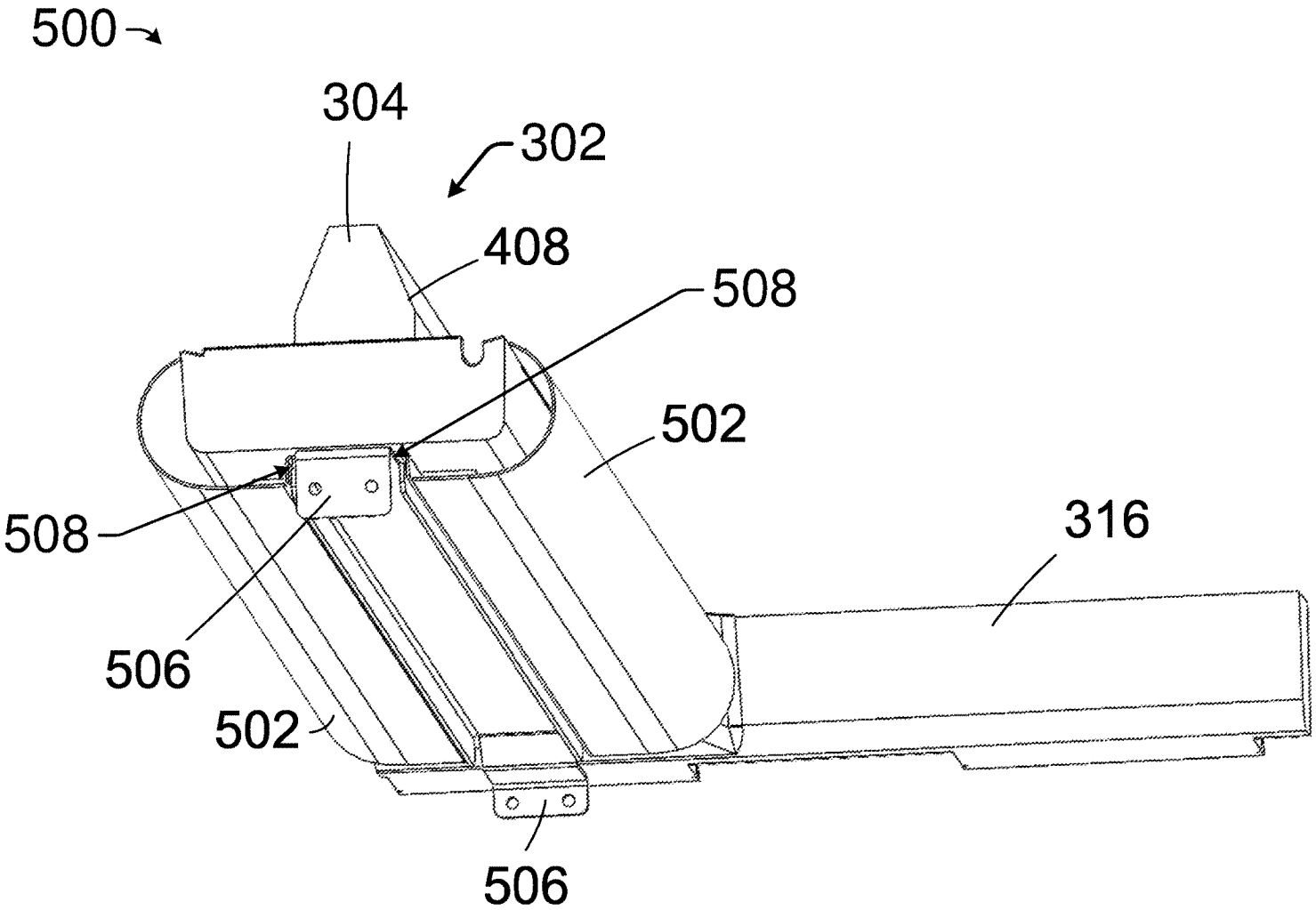
FIG. 8 is a bottom perspective view of the drain assembly of FIG. 5, according to an embodiment of the present disclosure.

FIG. 8 is a bottom perspective view of the drain assembly 500 of FIG. 5, according to an embodiment of the present disclosure.

Referring to FIG. 8, the drain pan 302, the raised portion 304, the support member 316, the second side 408, the heat shield portions 502, the bracket 506, and the connecting portions 508 are shown. The feet 702 of FIG. 7 are not shown in FIG. 8 because the heat shield portions 502 may partially cover the feet 702 by extending from the bracket 506 to the sides of the drain pan 302. The connecting portions 508 may slide so as to be disposed between the bracket 506 and the feet 702 as shown in FIG. 8 and further in FIG. 9.

Figure 9:
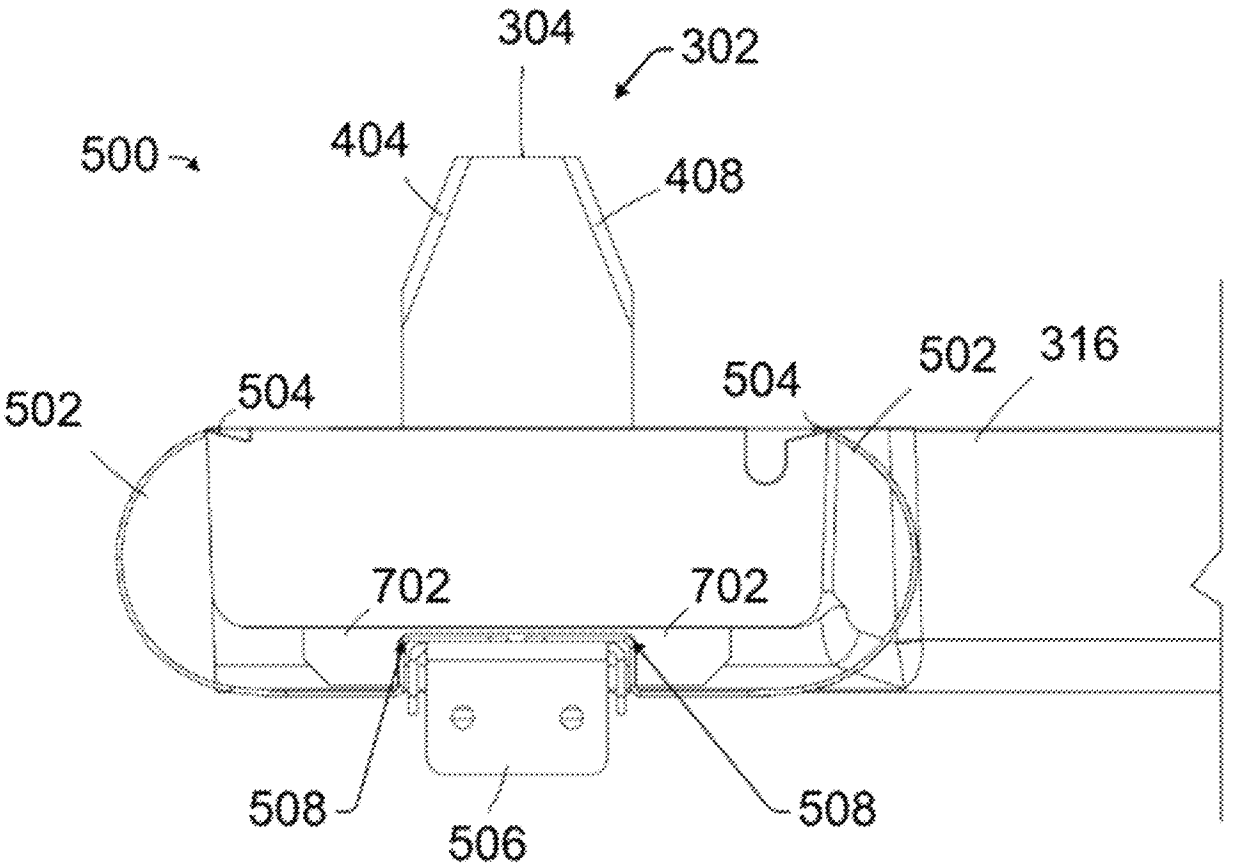
FIG. 9 is a front view of the drain assembly of FIG. 5, according to an embodiment of the present disclosure.

FIG. 9 is a front view of the drain assembly 500 of FIG. 5, according to an embodiment of the present disclosure.

Referring to FIG. 9, the drain pan 302, the raised portion 304, the support member 316, the first side 404, the second side 408, the heat shield portions 502, and the connecting portions 504, the bracket 506, and the connecting portions 508 are shown, along with the feet 702 of FIG. 7. As shown, the heat shield portions 502 extend around the feet 702, and the connecting portions 508 may be positioned in between the feet 702 and the bracket 506. The connecting portions 508 may slide so as to be disposed between the bracket 506 and the feet 702.

As will be appreciated, although the disclosed technology is shown in a particular configuration, the disclosed technology can be implemented in other configurations without departing from the scope of this disclosure. For example, although the present disclosure describes implementation of the drain assembly 110 to the V-coil heat exchanger, in some embodiments, the drain assembly 110 may be coupled to an N-coil heat exchanger, an A-coil heat exchanger, a Z-coil heat exchanger, or any other suitable type of heat exchanger. Therefore, while aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof.

What is claimed is:

1. A drain assembly for an AC furnace coil unit, the drain assembly comprising:

a drain pan defining one or more drain channels extending longitudinally therealong; and an arcuate heat shield detachably coupled to the drain pan, the arcuate heat shield extending along a length of the drain pan, wherein the arcuate heat shield comprises:

a first arcuate portion detachably coupled to the drain pan at a first portion of the first arcuate portion and to a bracket underneath the drain pan at a second portion of the first arcuate portion; and a second arcuate portion detachably coupled, independently of the first arcuate portion, to the drain pan at a first portion of the second arcuate portion and to the bracket at a second portion of the second arcuate portion, and wherein each of the first arcuate portion and the second arcuate portion is configured to:

define a cavity between an inner surface thereof and the drain pan; and distribute airflow, incident on an outer surface thereof, along longitudinal sides of the drain pan.

2. The drain assembly of claim 1, wherein the drain pan defines two or more receiving portions, and wherein the first portion of the first arcuate portion is configured to engage with a first of the two or more receiving portions and the first portion of the second arcuate portion is configured to engage with a second of the two or more receiving portions.

3. The drain assembly of claim 1, wherein the drain pan further comprises feet on a bottom portion of the drain pan, the feet comprising a first foot arranged on a first side of the bracket and a second foot arranged on a second side of the bracket opposite the first side, wherein the second portion of the first portion of the arcuate heat shield is configured to be disposed between the first foot and the bracket, and wherein the second portion of the second portion of the arcuate heat shield is configured to be disposed between the second foot and the bracket.

4. The drain assembly of claim 3, wherein the second portion of the first portion of the arcuate heat shield comprises a first flat surface configured to be at least partially disposed between the first foot and the bracket, and wherein the second portion of the second portion of the arcuate heat shield comprises a second flat surface configured to be at least partially disposed between the second foot and the bracket.

5. The drain assembly of claim 1, wherein each of the first portion of the first portion of the arcuate heat shield and the first portion of the second portion of the arcuate heat shield comprises a flange configured to engage with a respective slot of the drain pan.

6. The drain assembly of claim 1, wherein a profile of the drain pan is different than a profile of the arcuate heat shield.

7. The drain assembly of claim 6, wherein each of the first portion of the arcuate heat shield, the second portion of the arcuate heat shield, and the drain pan are partially separated from one another by each respective cavity based on the profile of the drain pan being different than the profile of the arcuate heat shield.

8. The drain assembly of claim 1, wherein each respective cavity forms a thermal insulation barrier between the arcuate heat shield and the drain pan.

9. A heat exchanger system comprising:

a drain pan defining one or more drain channels extending longitudinally therealong; and an arcuate heat shield detachably coupled to the drain pan, the arcuate heat shield extending along a length of the drain pan and wherein the arcuate heat shield comprises:

a first arcuate portion detachably coupled to the drain pan at a first portion of the first arcuate portion and to a bracket underneath the drain pan at a second portion of the first arcuate portion; and a second arcuate portion detachably coupled, independently of the first arcuate portion, to the drain pan at a first portion of the second arcuate portion and to the bracket at a second portion of the second arcuate portion, and wherein each of the first arcuate portion and the second arcuate portion is configured to:

define a cavity between an inner surface thereof and the drain pan; and distribute an airflow, incident on an outer surface thereof, along longitudinal sides of the drain pan.

10. The heat exchanger system of claim 9, wherein the drain pan defines two or more receiving portions, and wherein the first portion of the first arcuate portion is configured to engage with a first of the two or more receiving portions and the first portion of the second arcuate portion is configured to engage with a second of the two or more receiving portions.

11. The heat exchanger system of claim 10, wherein the drain pan further comprises feet on a bottom portion of the drain pan, the feet comprising a first foot arranged on a first side of the bracket and a second foot arranged on a second side of the bracket opposite the first side, wherein the second portion of the first portion of the arcuate heat shield is configured to be disposed between the first foot and the bracket, and wherein the second portion of the second portion of the arcuate heat shield is configured to be disposed between the second foot and the bracket.

12. The heat exchanger system of claim 9, wherein each of the first portion of the first portion of the arcuate heat shield and the first portion of the second portion of the arcuate heat shield comprises a lip configured to engage with a respective slot of the drain pan.

13. The heat exchanger system of claim 9, wherein a profile of the drain pan is different than a profile of the arcuate heat shield.

14. The heat exchanger system of claim 13, wherein each of the first portion of the arcuate heat shield, the second portion of the arcuate heat shield, and the drain pan are partially separated from one another based on the profile of the drain pan being different than the profile of the arcuate heat shield.

15. The heat exchanger system of claim 9, wherein each respective cavity is configured to distribute an air flow between the arcuate heat shield and the drain pan.

16. A drain pan heat shield for a furnace system, the drain pan heat shield comprising:

a first arcuate portion configured to detachably couple to a drain pan at a first portion of the first arcuate portion and to a bracket underneath the drain pan at a second portion of the first arcuate portion; and a second arcuate portion configured to detachably couple, independently of the first arcuate portion, to the drain pan at a first portion of the second arcuate portion and to the bracket at a second portion of the second arcuate portion, and wherein each of the first arcuate portion and the second arcuate portion is configured to:

define a cavity between an inner surface thereof and the drain pan; and distribute an airflow, incident on an outer surface thereof, along longitudinal sides of the drain pan.

17. The drain pan heat shield of claim 16, wherein the drain pan further comprises feet on a bottom portion of the drain pan, the feet comprising a first foot arranged on a first side of the bracket and a second foot arranged on a second side of the bracket opposite the first side, wherein the second portion of the first arcuate portion is configured to be disposed between the first foot and the bracket, and wherein the second portion of the second arcuate portion is configured to be disposed between the second foot and the bracket.

18. The drain pan heat shield of claim 16, wherein each of the first portion of the drain pan heat shield and the first portion of the second portion of the drain pan heat shield comprises a lip configured to engage with a respective slot of the drain pan.

19. The drain pan heat shield of claim 16, wherein the first portion of the drain pan heat shield and the second portion of the drain pan heat shield comprise a different curvature than the drain pan.

20. The drain pan heat shield of claim 16, wherein each respective cavity is configured to distribute an air flow between the drain pan heat shield and the drain pan.

* * * * *